US006116164A

United States Patent [19]

Justen, Jr.

[11] Patent Number: 6,116,164

[45] Date of Patent: Sep. 12, 2000

[54] SUSPENDED SHELVING APPARATUS

[76] Inventor: Eugene James Justen, Jr., 1922 Hamby Place Dr., Acworth, Ga. 30102

[21] Appl. No.: 09/281,341

[22] Filed: Mar. 30, 1999

[51] Int. Cl.[7] ..... A47B 23/00

[52] U.S. Cl. ..... 108/42; 211/113; 211/90.01

[58] Field of Search ..... 108/42, 47, 92, 108/152, 128; 211/113, 90.01

[56] References Cited

U.S. PATENT DOCUMENTS

| | | | |
|---|---|---|---|
| D. 270,977 | 10/1983 | Kneale, III . | |
| 349,255 | 9/1886 | Jackson | 211/113 X |
| 384,143 | 6/1888 | Gardiner | 211/113 X |
| 488,757 | 12/1892 | Friendlcih | 211/113 |
| 2,205,193 | 6/1940 | Goldman | 108/152 X |
| 2,206,753 | 7/1940 | Roth . | |
| 2,556,105 | 6/1951 | Rhett . | |
| 3,025,970 | 3/1962 | Ostrom . | |
| 3,282,547 | 11/1966 | Ables . | |
| 3,330,419 | 7/1967 | Joseph . | |
| 3,340,829 | 9/1967 | Palmer . | |
| 3,799,072 | 3/1974 | Slaboden . | |
| 3,901,165 | 8/1975 | Schlesinger | 211/113 X |
| 4,061,092 | 12/1977 | Jacobsen et al. . | |
| 4,125,302 | 11/1978 | Peritz et al. . | |
| 4,129,080 | 12/1978 | Vall . | |
| 4,187,787 | 2/1980 | Nakatsu . | |
| 4,244,301 | 1/1981 | Nakatsu . | |
| 4,254,881 | 3/1981 | Hard | 211/113 X |
| 4,317,522 | 3/1982 | Garrett | 211/113 |
| 4,523,526 | 6/1985 | O'Neill | 211/113 X |
| 4,974,523 | 12/1990 | Glarratana . | |
| 5,052,648 | 10/1991 | Landau . | |
| 5,427,344 | 6/1995 | Beauchemin . | |
| 5,542,530 | 8/1996 | Freelander . | |
| 5,810,457 | 9/1998 | Felsenthal et al. . | |

FOREIGN PATENT DOCUMENTS

| | | | |
|---|---|---|---|
| 444805 | 2/1968 | Switzerland | 211/113 |
| 232797 | 4/1924 | United Kingdom | 211/113 |

*Primary Examiner*—Jose V. Chen

*Attorney, Agent, or Firm*—Myers & Associates, Intellectual Property Law, P.C.

[57] ABSTRACT

A suspended shelving apparatus wherein a plurality of shelves can easily be horizontally repositioned, added and/or removed. More specifically, in a preferred embodiment, the structure comprises a plurality of shelves, hooks and chains. Each shelf has two truncated hooks, a distal hook and a proximal hook, secured on each end positioned a distance apart. A first right chain support is secured via a hook in a stud or fixed point and extends downward therefrom. A second right chain support is secured to the hook in stud or fixed point and extends downward therefrom. The proximal hook on the right end of the shelf is secured to first right chain support while the distal hook on the right end of the shelf is secured to second right chain support. The left side support is a mirror image of the right side support. This design allows for a multitude of shelves to be easily attached and removed from chain supports in a plurality of horizontal positions by simply lifting up on the shelf, positioning the shelf at the desired location and then securing each hook into the respective link of the chain.

12 Claims, 3 Drawing Sheets

10
40
5
50
20
30
42
44
50
20
30
50
20
30

SUSPENDED SHELVING APPARATUS

TECHNICAL FIELD

The present invention relates generally to shelving, and, more specifically, to a suspended shelving apparatus capable of removably supporting a plurality of shelves.

BACKGROUND ART

Because of the universal need for display/storage shelving, a multitude of suspended shelving designs have been purposed. However, prior suspended shelving systems have many deficiencies. For example, many of the previous designs are complicated, requiring an increase in components and thus, enlarging the costs of manufacture. Examples of such designs may be found by reference to U.S. Pat. No. D270,977 to Kneale, III, U.S. Pat. No. 2,206,753 to Roth, U.S. Pat. No. 2,556,105 to Rhett, U.S. Pat. No. 3,025,970 to Ostrom, U.S. Pat. No. 3,282,547 to Ables, U.S. Pat. No. 3,340,829 to Palmer, U.S. Pat. No. 3,799,072 to Slaboden, U.S. Pat. No. 3,901,165 to Schlesinger, U.S. Pat. No. 4,061,092 to Jacobsen et al., U.S. Pat. No. 4,129,080 to Vall, U.S. Pat. No. 4,187,787 to Nakatsu, U.S. Pat. No. 4,244,301 to Nakatsu, U.S. Pat. No. 4,523,526 to O'Neill, U.S. Pat. No. 4,974,523 to Giarratana, U.S. Pat. No. 5,052,648 to Landau, and U.S. Pat. No. 5,427,344 to Beauchemin.

Additionally, many of the previous designs require additional wall securing means at the rear of each shelf to secure said shelving in position and thus, do not function as suspended shelving. Examples of such designs may be found by reference to U.S. Pat. No. 3,025,970 to Ostrom, U.S. Pat. No. 3,282,547 to Ables, U.S. Pat. No. 3,340,829 to Palmer, U.S. Pat. No. 3,799,072 to Slaboden, U.S. Pat. No. 4,129,080 to Vall and U.S. Pat. No. 4,974,523 to Giarratana.

Another deficiency of previous suspended shelf designs is that they do not allow for, or are capable of, supporting a multitude of shelves. Examples of such designs may be found by reference to U.S. Pat. No. 3,282,547 to Ables, U.S. Pat. No. 3,901,165 to Schlesinger, U.S. Pat. No. 4,974,523 to Giarratana and U.S. Pat. No. 5,052,648 to Landau.

Moreover, many of the designs that do support a plurality of shelves do not provide means for easily adding, removing and/or horizontally repositioning the shelves. Examples of such designs may be found by reference to U.S. Pat. No. 2,206,753 to Roth, U.S. Pat. No. 2,556,105 to Rhett, U.S. Pat. No. 3,025,970 to Ostrom, U.S. Pat. No. 3,282,547 to Ables, U.S. Pat. No. 3,340,829 to Palmer, U.S. Pat. No. 3,799,072 to Slaboden, U.S. Pat. No. 3,901,165 to Schlesinger, U.S. Pat. No. 4,061,092 to Jacobsen et al., U.S. Pat. No. 4,129,080 to Vall, U.S. Pat. No. 4,187,787 to Nakatsu, U.S. Pat. No. 4,244,301 to Nakatsu, U.S. Pat. No. 4,974,523 to Giarratana, U.S. Pat. No. 5,052,648 to Landau, and U.S. Pat. No. 5,427,344 to Beauchemin. Although some of the above referenced patents do allow horizontal movement of individual shelves and the addition or removal of individual shelves, these designs require either the addition of supplemental parts, the untying and/or tying of strings, the disassembly and assembly of the entire structure, the unsecuring and resecuring of a shelf from a rear wall mount, and/or the repositioning of the shelf support means.

As shelving serves to facilitate the display/storage of various items, an essential feature and purpose of shelving is to maximize the available shelving space. In other words, shelving designs should be spatially efficient. However, the support members of previous designs are either channeled through a portion of the shelving or attached to the front of the shelving thereby interfering and reducing the available shelf space. As such, previous designs are deficient in maximizing display/storage space. Examples of such designs may be found by reference to U.S. Pat. No. D270,977 to Kneale, III, U.S. Pat. No. 2,206,753 to Roth, U.S. Pat. No. 2,556,105 to Rhett, U.S. Pat. No. 3,025,970 to Ostrom, U.S. Pat. No. 3,282,547 to Ables, U.S. Pat. No. 3,340,829 to Palmer, U.S. Pat. No. 3,799,072 to Slaboden, U.S. Pat. No. 3,901,165 to Schlesinger, U.S. Pat. No. 4,061,092 to Jacobsen et al., U.S. Pat. No. 4,129,080 to Vall, U.S. Pat. No. 4,187,787 to Nakatsu, U.S. Pat. No. 4,244,301 to Nakatsu, U.S. Pat. No. 4,523,526 to O'Neill, U.S. Pat. No. 4,974,523 to Giarratana, U.S. Pat. No. 5,052,648 to Landau, and U.S. Pat. No. 5,427,344 to Beauchemin.

It is readily apparent that a new, improved and inexpensive suspended shelving design is needed wherein the shelves can easily be horizontally repositioned, added and/or removed. It is, therefore, to the provision of such an improvement that the present invention is directed.

BRIEF SUMMARY OF THE INVENTION

Briefly described, in a preferred embodiment, the present invention overcomes the above-mentioned disadvantages by providing a suspended shelving apparatus wherein a plurality of shelves can easily be horizontally repositioned, added and/or removed. More specifically, in a preferred embodiment, the present invention comprises a plurality of shelves, hooks and chains.

Each shelf has two truncated hooks, a distal hook and a proximal hook, secured on each end positioned a distance apart. A first right chain support is secured via a hook means in a stud or fixed point and extends downward therefrom. A second right chain support is secured to said hook means in said stud or fixed point and extends downward therefrom. The proximal hook on the right end of the shelf is secured to said first right chain support while the distal hook on the right end of the shelf is secured to said second right chain support. The left side support is a mirror image of the right side support. This design allows for a multitude of shelves to be easily attached and removed from said chain supports in a plurality of horizontal positions by simply lifting up on the shelf, positioning the shelf at the desired location and then securing each hook into the respective link of the chain A feature and advantage of the present invention is to provide a new and improved adjustable suspended shelving apparatus that is simple in design yet capable of supporting a plurality of shelves.

A feature and advantage of the present invention is to provide a new and improved adjustable suspended shelving apparatus wherein each shelf can be removably secured at a plurality of horizontal positions.

A feature and advantage of the present invention is to provide a new and improved adjustable suspended shelving apparatus wherein shelves can be easily added or removed without disassembly of the supporting means.

A feature and advantage of the present invention is to provide a new and improved adjustable suspended shelving apparatus that is simple in design and thus inexpensive to manufacture.

A feature and advantage of the present invention is to provide a new and improved adjustable suspended shelving apparatus wherein the supporting means does not interfere with shelving space.

A feature and advantage of the present invention is to provide a new and improved adjustable suspended shelving apparatus that only needs two wall/ceiling securing means to support a plurality of shelves, thus reducing the complexity of installation and the number of securing means as with previous designs.

A feature and advantage of the present invention is to provide a new and improved adjustable suspended shelving apparatus that eliminates the need for shelf braces as with traditional shelving, thus increasing the display/storage space for horizontally stacked shelving.

These and other objects, features and advantages of the invention will become more apparent to one skilled in the art from the following description and claims when read in light of the accompanying drawings.

DETAILED DESCRIPTION OF THE PREFERRED EMBODIMENT

Figure 1:
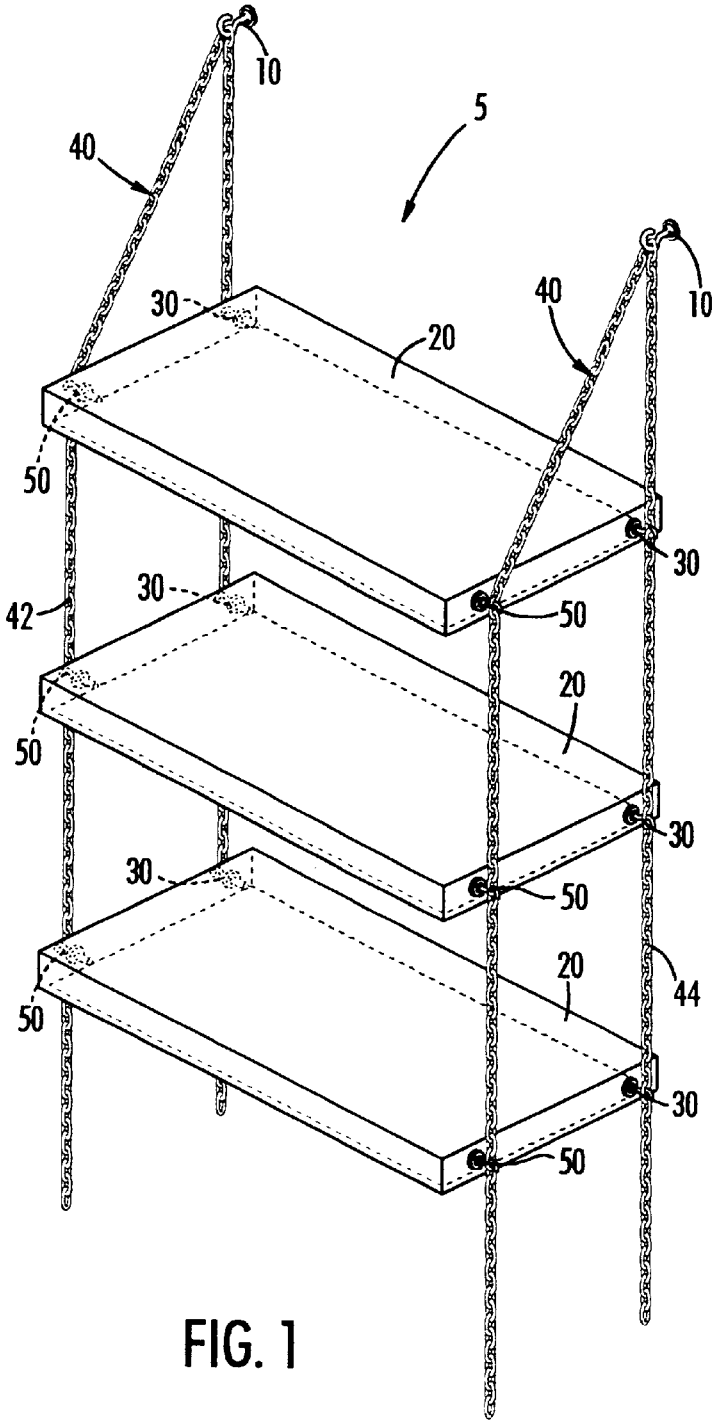
FIG. 1 is a perspective view of the apparatus according to a preferred embodiment of the present invention.
Figure 2:
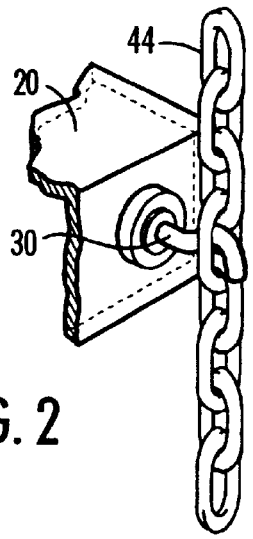
FIG. 2 is a partial perspective view of a shelf-supporting device according to a preferred embodiment of the present invention.
Figure 3:
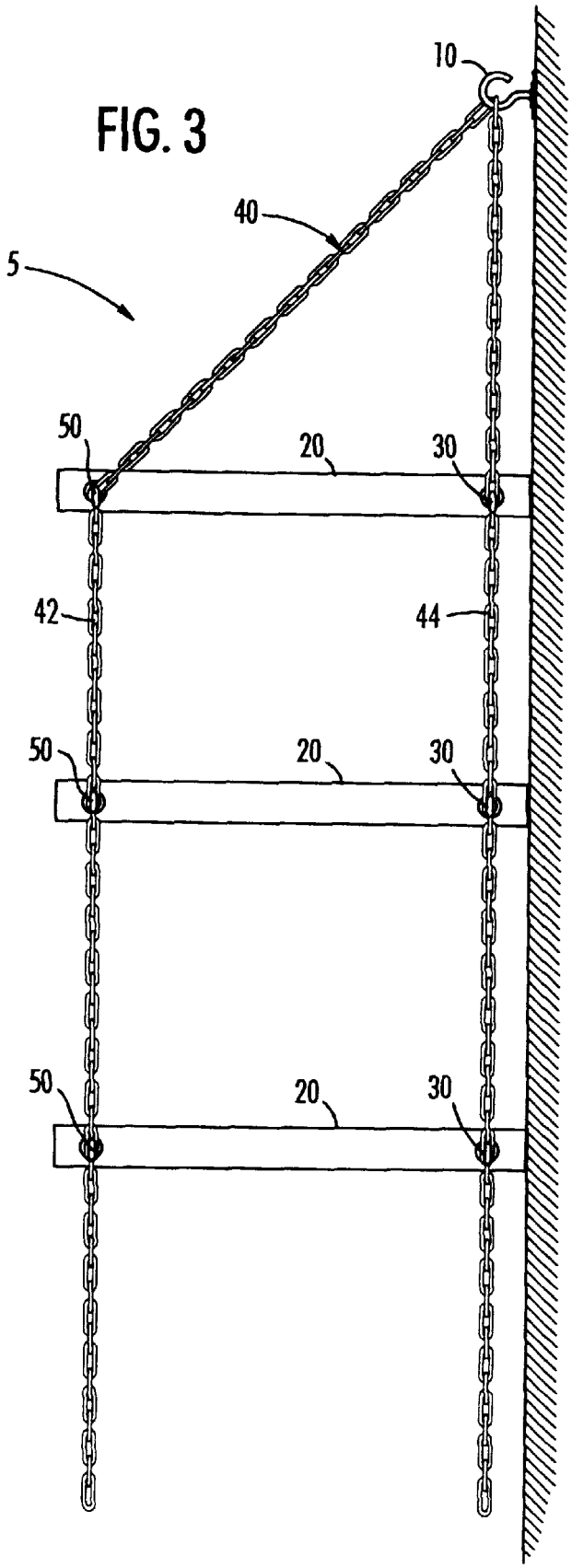
FIG. 3 is a side view of the apparatus according to a preferred embodiment of the present invention.

Referring now to the FIGS. 1–3, apparatus 5 generally comprises wall hooks 10, shelves 20, first shelf hooks 30, chain 40 and second shelf hooks 50.

Figure 4:
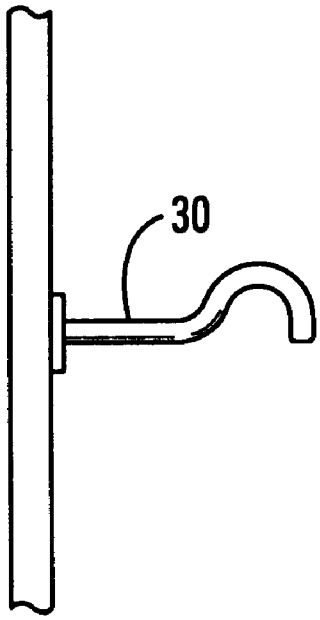
FIG. 4 is a side view of the hook as shown in FIG. 2 according to a preferred embodiment of the present invention-page.

More specifically, in a preferred embodiment, each shelf 20 contains four hooks with two positioned on each end of each shelf 20. First shelf hooks 30 are attached to each end of each shelf 20 near the rear edge of shelf 20. Second shelf hooks 50 are attached to each end of each shelf 20 near the front edge of shelf 20. First shelf hooks 30 and second shelf hooks 50 are positioned so that the open side of each hook faces downward. Additionally, unlike traditional hooks, in the preferred embodiment the ends of first shelf hooks 30 and second shelf hooks 50 are truncated to facilitate the unhooking and repositioning and/or removal or addition of a plurality of shelves 20 to a multitude of horizontal positions along chain 40. As exemplified in FIG. 2, and FIG. 4 first shelf hooks 30 and second shelf hooks 50 generally first extend perpendicular from the end of shelves 20 with a generally arcuate portion extending therefrom, wherein the arcuate portion is open downwardly.

Secured to a wail, ceiling or other relatively fixed structure is preferably two wall hooks 10 positioned a distance apart approximately equal to the length of shelf 20 and preferably in the same horizontal plane. Preferably, wall hooks 10, when secured to a wall, are secured into studs to provide added support.

Attached to wall hook 10 and extending downward therefrom is chain 40. Chain 40 may be one continuous chain or two separate chains wherein two portions, first chain 44 and second chain 42, extend downward from wall hook 10. First shelf hook 30 of each shelf 20 hooks to a link of first chain 44, and second shelf hook 50 of each shelf 20 hooks to a link of second chain 42, preferably in the same horizontal plane such that each shelf 20 is level. The arcuate portion of each hook rest upon the lower portion of each respective link. Because of the truncated design for first shelf hooks 30 and second shelf hooks 50, a shelf 20 can be slightly raised from its resting position thereby disengaging the respective links from the arcuate portions of each hook, thus allowing shelf 20 to be raised, lowered or removed as desired.

To accommodate larger or smaller shelving it is apparent that the dimensions of apparatus 5 may be varied accordingly. In addition, the size and/or shape of chain 40 may be varied to accommodate varies sized and shaped hooks. It is also apparent that other supporting means having a plurality of vertically-spaced-apart throughholes may be utilized in lieu of chain 40. A variety of materials such as, but not limited to, plastic, metal, wood, particle board or cardboard may be utilized for shelves 20 to vary the structural strength, weight and/or esthetics as is appropriate for the application. In addition, a variety of materials and coatings such as, but not limited to, brass, bronze, gold, silver, platinum, iron or titanium may be utilized for chain 40 to vary the structural strength, weight and/or esthetics as is appropriate for the application. Additionally, various styles of chains may be utilized as desired by the user.

The above detailed description of a preferred embodiment or alternate embodiments are for exemplary purposes only and are not meant to limit the scope or spirit of the invention as defined by the appended claims.

What is claimed is:

1. A suspended shelf apparatus attachable to a fixed object, comprising:

at least one shelf having a first end, a second end, a front edge and a rear edge;

a first securing means attachable to the fixed object;

a second securing means attachable to the fixed object;

a first elongated portion having a plurality of apertures therethrough, said first elongated portion carried by said first securing means wherein said first elongated portion extends downward from said first securing means;

a second elongated portion having a plurality of apertures therethrough, said second elongated portion carried by said first securing means wherein said second elongated portion extends downward from said first securing means;

a third elongated portion having a plurality of apertures therethrough, said third elongated portion carried by said second securing means wherein said third elongated portion extends downward from said second securing means;

a fourth elongated portion having a plurality of apertures therethrough, said fourth elongated portion carried by said second securing means wherein said fourth elongated portion extends downward from said second securing means;

first mounting means carried on said first end of said shelf proximal to said rear edge;

second mounting means carried on said first end of said shelf proximal to said front edge;

third mounting means carried on said second end of said shelf proximal to said rear edge; and fourth mounting means carried on said second end of said shelf proximal to said front edge;

wherein said first mounting means removably engages one of said plurality of apertures in said first elongated portion, said second mounting means removably engages one of said plurality of apertures in said second elongated portion, said third mounting means removably engages one of said plurality of apertures in said third elongated portion, and said fourth mounting means removably engages one of said plurality of apertures on said fourth elongated portion.

2. The apparatus of claim 1, wherein said first securing means and said second securing means is a hook.

3. The apparatus of claim 1, wherein said first elongated portion, said second elongated portion, said third elongated portion and said fourth elongated portion are chains.

4. The apparatus of claim 1, wherein said first mounting means, said second mounting means, said third mounting means and said fourth mounting means are hooks.

5. The apparatus of claim 1, wherein said first mounting means, said second mounting means, said third mounting means and said fourth mounting means comprises:

a straight portion having a first end and a second end, a U-shaped portion having a first end and a second end, wherein said first end of said straight portion is attached to said shelf, said second end of said straight portion is attached to said first end of said U-shaped portion, and wherein said second end of said U-shaped portion ends in the same horizontal plane as said straight portion.

6. A suspended shelf apparatus attachable to a fixed object, comprising:

at least one shelf having a first end, a second end, a front edge and a rear edge;

a first hook attachable to the fixed object;

a second hook attachable to the fixed object;

a first elongated portion having a plurality of apertures therethrough, said first elongated portion carried by said first hook wherein said first elongated portion extends downward from said first hook;

a second elongated portion having a plurality of apertures therethrough, said second elongated portion carried by said first hook wherein said second elongated portion extends downward from said first hook;

a third elongated portion having a plurality of apertures therethrough, said third elongated portion carried by said second hook wherein said third elongated portion extends downward from said second hook;

a fourth elongated portion having a plurality of apertures therethrough, said fourth elongated portion carried by said second hook wherein said fourth elongated portion extends downward from said second hook;

first mounting means carried on said first end of said shelf proximal to said rear edge;

second mounting means carried on said first end of said shelf proximal to said front edge;

third mounting means carried on said second end of said shelf proximal to said rear edge; and fourth mounting means carried on said second end of said shelf proximal to said front edge;

wherein said first mounting means removably engages one of said plurality of apertures in said first elongated portion, said second mounting means removably engages one of said plurality of apertures in said second elongated portion, said third mounting means removably engages one of said plurality of apertures in said third elongated portion, and said fourth mounting means removably engages one of said plurality of apertures on said fourth elongated portion.

7. The apparatus of claim 6, wherein said first elongated portion, said second elongated portion, said third elongated portion and said fourth elongated portion are chains.

8. The apparatus of claim 6, wherein said first mounting means, said second mounting means, said third mounting means and said fourth mounting means are hooks.

9. The apparatus of claim 6, wherein said first mounting means, said second mounting means, said third mounting means and said fourth mounting means comprises:

a straight portion having a first end and a second end, a U-shaped portion having a first end and a second end, wherein said first end of said straight portion is attached to said shelf, said second end of said straight portion is attached to said first end of said U-shaped portion, and wherein said second end of said U-shaped portion ends in the same horizontal plane as said straight portion.

10. A suspended shelf apparatus attachable to a fixed object, comprising:

at least one shelf having a first end, a second end, a front edge and a rear edge;

a first hook attachable to the fixed object;

a second hook attachable to the fixed object;

a first chain having a plurality of loops, said first chain carried by said first hook wherein said first chain extends downward from said first hook;

a second chain having a plurality of loops, said second chain carried by said first hook wherein said second chain extends downward from said first hook;

a third chain having a plurality of loops, said third chain carried by said second hook wherein said third chain extends downward from said second hook;

a fourth chain having a plurality of apertures therethrough, said fourth chain carried by said second hook wherein said fourth chain extends downward from said second hook;

first mounting means carried on said first end of said shelf proximal to said rear edge;

second mounting means carried on said first end of said shelf proximal to said front edge;

third mounting means carried on said second end of said shelf proximal to said rear edge; and fourth mounting means carried on said second end of said shelf proximal to said front edge, wherein said first mounting means removably engages one of said plurality of loops of said first chain, said second mounting means removably engages one of said plurality of loops in said second chain, said third mounting means removably engages one of said plurality of loops in said third chain, and said fourth mounting means removably engages one of said plurality of loops in said fourth chain.

11. The apparatus of claim 10, wherein said first mounting means, said second mounting means, said third mounting means and said fourth mounting means are hooks.

12. The apparatus of claim 10, wherein said first mounting means, said second mounting means, said third mounting means and said fourth mounting means comprises:

a straight portion having a first end and a second end;

a U-shaped portion having a first end and a second end, wherein said first end of said straight portion is attached to said shelf, said second end of said straight portion is attached to said first end of said U-shaped portion, and wherein said second end of said U-shaped portion ends in the same horizontal plane as said straight portion.

* * * * *